US008494759B2

(12) United States Patent
Hada

(10) Patent No.: US 8,494,759 B2
(45) Date of Patent: Jul. 23, 2013

(54) VEHICLE SPEED INDICATION USING VEHICLE-INFRASTRUCTURE WIRELESS COMMUNICATION

(75) Inventor: Hideki Hada, Ann Arbor, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 428 days.

(21) Appl. No.: 12/877,617

(22) Filed: Sep. 8, 2010

(65) Prior Publication Data

US 2012/0059574 A1 Mar. 8, 2012

(51) Int. Cl.
*G08G 1/052* (2006.01)

(52) U.S. Cl.
USPC ..... 701/117; 701/118; 701/119

(58) Field of Classification Search
USPC ..... 701/117–119; 340/466, 901, 905, 340/906
See application file for complete search history.

(56) References Cited

U.S. PATENT DOCUMENTS

| | | | | |
|---|---|---|---|---|
| 3,229,249 | A | 1/1966 | Brenner | |
| 5,694,122 | A | 12/1997 | Nakada | |
| 5,831,552 | A | 11/1998 | Sogawa et al. | |
| 5,864,305 | A | 1/1999 | Rosenquist | |
| 6,317,058 | B1 | 11/2001 | Lemelson et al. | |
| 6,462,675 | B1 | 10/2002 | Humphrey et al. | |
| 6,574,548 | B2 * | 6/2003 | DeKock et al. | 701/117 |
| 6,741,932 | B1 | 5/2004 | Groth et al. | |
| 6,807,464 | B2 | 10/2004 | Yu et al. | |
| 6,856,902 | B1 | 2/2005 | Mitchem | |
| 7,027,915 | B2 | 4/2006 | Craine | |
| 7,362,239 | B2 | 4/2008 | Franczyk et al. | |
| 7,439,853 | B2 * | 10/2008 | Tengler et al. | 340/466 |
| 7,706,963 | B2 | 4/2010 | Parikh et al. | |
| 2002/0107634 | A1 | 8/2002 | Luciani | |
| 2005/0280553 | A1 | 12/2005 | DiPiazza | |
| 2006/0226968 | A1 | 10/2006 | Tengler et al. | |
| 2007/0185648 | A1 | 8/2007 | Gretton | |
| 2007/0225902 | A1 | 9/2007 | Gretton et al. | |
| 2009/0210141 | A1 | 8/2009 | Young et al. | |
| 2010/0123778 | A1 | 5/2010 | Hada | |
| 2010/0211247 | A1 | 8/2010 | Sherony | |

FOREIGN PATENT DOCUMENTS

| | | | |
|---|---|---|---|
| AU | 2009101172 | A4 | 12/2009 |
| WO | WO-2006012696 | A2 | 2/2006 |

OTHER PUBLICATIONS

Carter, Arthur A., "The status of vehicle-to-vehicle communication as a means of improving crash prevention performance," NHTSA Technical Report, 2005.

Carter, A.A., Chang, J., "Using dedicated short range communications for vehicle safety applications—the next generation of collision avoidance," NHTSA Technical Report, 2009.

Sugiyama, Y., Fukui, M., Kikuchi, M., Hasebe, K.., Nakayama, A., Nishinari, K., Tadaki, S., Yukawa, S., "Traffic jams without bottlenecks—experimental evidence for the physical mechanism of the formation of a jam," New J. Phys. 10 (2008).

* cited by examiner

*Primary Examiner* — Richard M. Camby
(74) *Attorney, Agent, or Firm* — Gifford, Krass, Sprinkle, Anderson & Citkowski, P.C.

(57) ABSTRACT

An example traffic control system includes a vehicle unit associated with a vehicle on a highway, one or more roadside units proximate the highway, and a traffic controller. The vehicle unit transmits a vehicle speed to the roadside unit, when in wireless communication range. The roadside unit transmits the vehicle speed to the traffic controller. The traffic controller receives vehicle speed data from a plurality of vehicles, and determines a suggested speed for each vehicle. The suggested speed may be correlated with an average speed of vehicles on a portion of the highway, for example the same highway portion on which vehicle is located, or a highway portion towards which the vehicle is heading.

19 Claims, 4 Drawing Sheets

FIG. 4
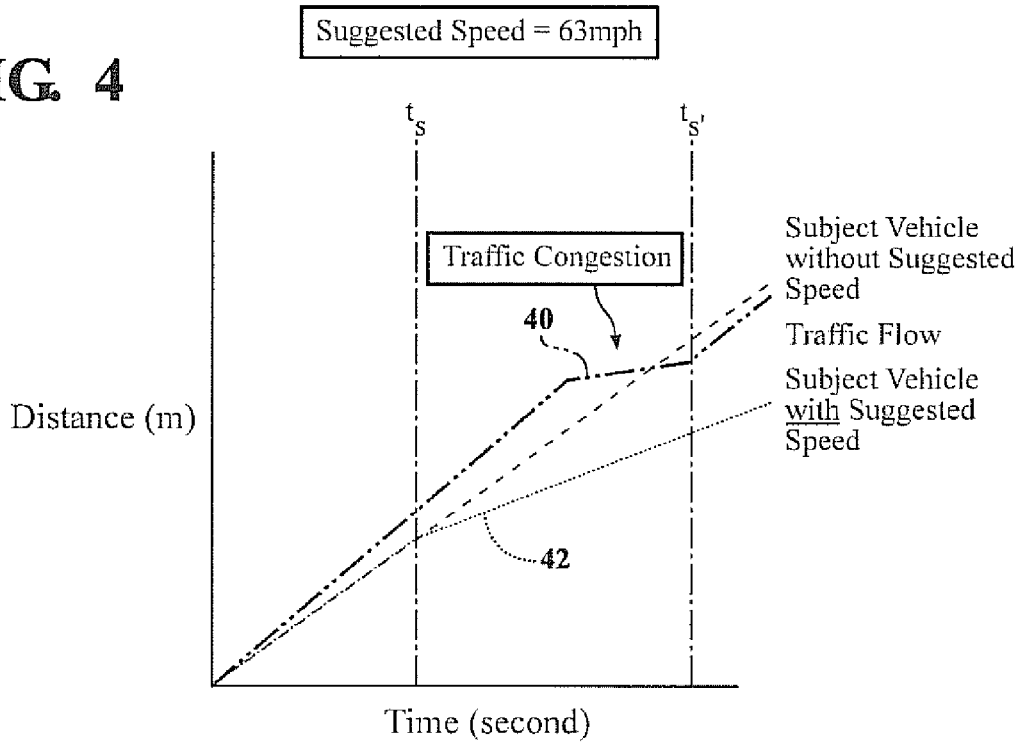
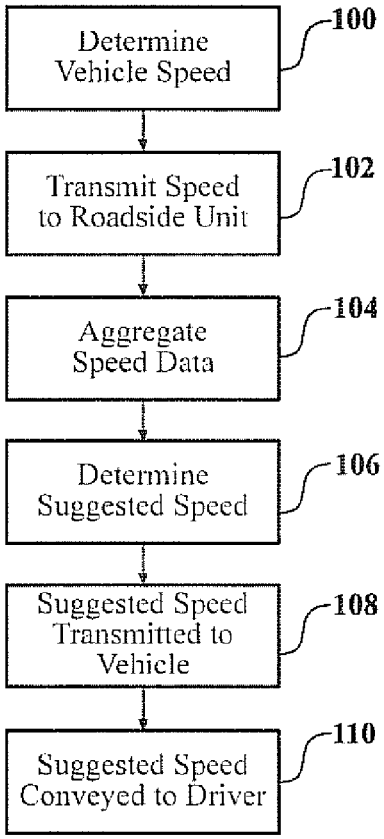
FIG. 5

VEHICLE SPEED INDICATION USING VEHICLE-INFRASTRUCTURE WIRELESS COMMUNICATION

FIELD OF THE INVENTION

The present invention relates to traffic management, including assisting a driver to select a vehicle speed that improves traffic flow.

BACKGROUND OF THE INVENTION

Examples of the present invention include apparatus and methods allowing improved traffic management and allowing more efficient vehicle operation. Examples include suggested vehicle speed indicator systems using vehicle-to-infrastructure wireless communications. An example approach informs a driver of a suggested speed, which may be determined by a traffic controller as the optimal traveling speed for the highway, and which may be less than the posted speed limit. If one or more drivers adjust their vehicle speed to approximate the suggested speed, traffic flow may be smoothed out and vehicle safety enhanced. A suggested speed can be assigned to each suitably equipped vehicle along specific portions of the highway.

SUMMARY OF THE INVENTION

Examples of the present invention include apparatus and methods allowing improved traffic management and allowing more efficient vehicle operation. Examples include suggested vehicle speed indicator systems using vehicle-to-infrastructure wireless communications. An example approach informs a driver of a suggested speed, which may be determined by a traffic controller as the optimal traveling speed for the highway, and which may be less than the posted speed limit. If one or more drivers adjust their vehicle speed to approximate the suggested speed, traffic flow may be smoothed out and vehicle safety enhanced. A suggested speed can be assigned to each suitably equipped vehicle along specific portions of the highway.

Examples of the present invention include apparatus and methods for determining a suggested speed for a subject vehicle on a highway or portion thereof, and communicating the suggested speed to the driver of the subject speed. An example system includes a two-way wireless communication device in electronic communications with one or more vehicle electronics systems (as part of a vehicle unit), a roadside wireless communication device (referred to as a roadside unit), and a traffic controller. The communication device in the vehicle records and transmits the average speed of the vehicle to the roadside communication device, which then communicates that information with the traffic controller. The traffic controller then calculates the average speed of all of the vehicles on the same highway and communicates a suggested speed based on the average back to the vehicle. The suggested speed may be faster or slower than the present speed of the vehicle, and may differ appreciably from the posted speed limit.

An example system comprises a vehicle unit, a roadside unit, and a traffic controller. The vehicle unit includes a transceiver, transmitting the vehicle speed to the roadside unit and receiving a suggested speed from the roadside unit. The suggested speed is determined by the traffic controller, using vehicle speeds from a plurality of vehicles. The vehicle unit then conveys the suggested speed to the driver. A roadside unit (which may also be termed roadside electronics, RSE) may use DSRC (dedicated short range communications) to communicate with the vehicle.

A plurality of roadside units collect vehicle speeds at intervals along the highway and transmit the vehicle speed data to a traffic controller. The traffic controller then determines an optimal vehicle speed for each vehicle at different locations on the highway. The suggested speed may be significantly less than the posted speed limit, for example when the vehicle is approaching a portion of the highway having slow moving vehicles. Vehicle speed data can be collected from vehicles directly, using wireless communication, and also from roadside sensors such as video cameras and speed measurement devices.

The vehicle unit may convey the suggested speed to the driver using any appropriate method. The suggested speed may be displayed numerically, for example on the dashboard of the vehicle, using graphical symbols (such as higher or lower symbols), or using audio signals. The suggested speed may be presented as an absolute value, or relative to the vehicle's present speed. For example, feedback may be given to the driver according to whether the suggested speed is higher or lower than the present vehicle speed.

BRIEF DESCRIPTION OF THE FIGURES

FIG. 4 illustrates how a suggested speed may be significantly less than a posted speed limit in the case of traffic congestion ahead of the vehicle.

FIG. 5 illustrates a method according to an example of the present invention.

DETAILED DESCRIPTION OF THE INVENTION

Figure 1A:
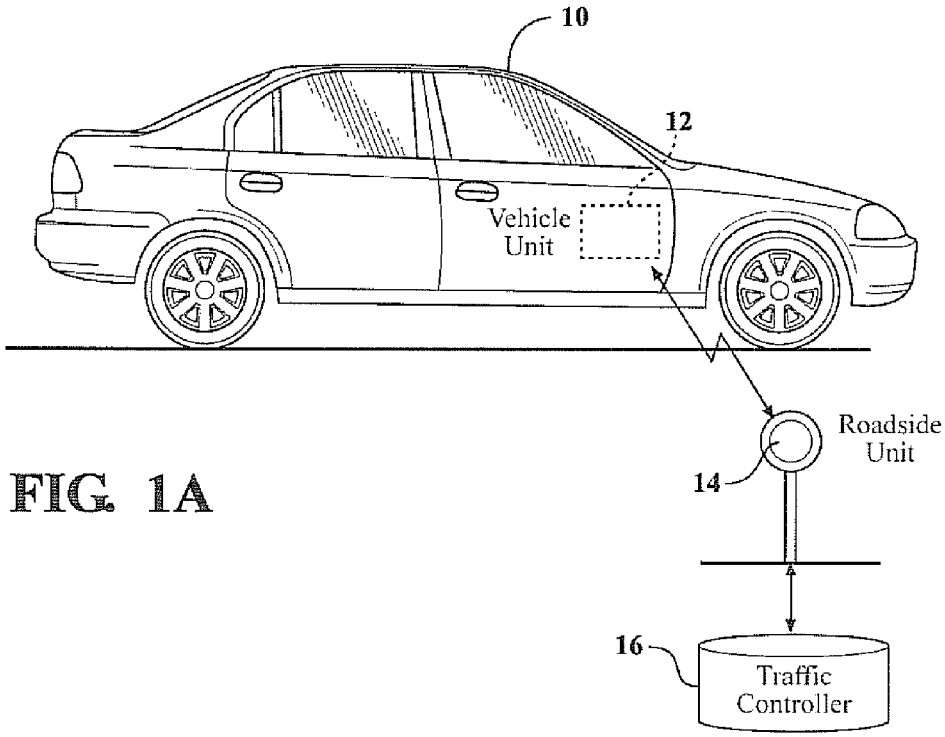
FIGS. 1A-1C are simplified schematics of a system according to an example of the present invention.

A vehicle operator (driver) determines the best vehicle speed based on a variety of factors, such as the posted speed limit and surrounding traffic situation. However, in the absence of further information, the best efforts of the drivers on a highway may lead to a sub-optimal speed selection, which may lead to stop-go traffic. As a result, crashes, traffic congestion, slow traffic, and highly fluctuating vehicle speeds occur. These problems may be particularly prevalent if there is congestion, for example if the vehicle density on the highway exceeds that for which the highway is designed.

Traffic jams occur even without a triggering event such as construction or a previous accident. For example, in high density traffic, waves of stopped or slow moving traffic may propagate along the highway even in the absence of outside obstacles. Using a suggested speed, however, traffic jams and slow travel can be reduced or eliminated, with great improvement of safety, highway capacity, fuel economy, and reduced environmental impact. By suggesting an optimal driving speed to the driver, the driver has a chance to travel in a smoother, safer, and more environmentally friendly way along the highway. Conventionally, such information is not available to the driver.

In examples of the present invention, a traffic controller determines optimal traveling speeds for vehicles at different locations along the highway. These suggested speeds may vary continuously as a function of time and position along the highway. The determined optimal speeds are presented to the driver as a suggested speed. The driver may not choose to drive at the suggested speed, but is motivated to do so as following the suggested speed allows the driver to avoid regions of congestion and sudden decelerations. Hence, the safety advantages make it attractive to a driver to follow the suggested speed.

In some examples, two way wireless communications between a vehicle unit and a roadside unit allows exchange of data, such as vehicle speed and suggested speed determined by the traffic controller. The suggested speed is additional information to the driver, along with the observed posted speed limit and speed of surrounding vehicles. However, the provision of suggested speeds to drivers facilitates smoother, congestion-free traffic.

In some examples, the suggested speed may vary with lane position on the highway. For example, a vehicle in the right lane may receive a higher suggested speed than a vehicle in the left lane of a highway, for example if the left lane is congested ahead. Normally, it is expected that faster vehicles use the left lane while fast vehicles use the center lane and slower vehicles use the right lane. However, in congested highways these lanes may be used in a more or less random manner. The use of suggested speeds as a function of lane position allows improvement of traffic management along the individual lanes, allowing higher throughput of vehicles.

A vehicle operator controls the speed of the vehicle using factors such as the posted speed limit. However, attempting to drive the posted speed limit may lead to stop-go traffic conditions, giving inefficient and aggravating driving conditions. Examples of the present invention include methods and apparatus for conveying a suggested speed to a vehicle operator. The suggested speed may be less than the posted speed limit, even in conditions where travel at the posted speed limit is possible. An example is where there is congestion ahead of the vehicle.

FIG. 1A shows a simplified schematic of an example apparatus showing the vehicle unit 12 supported within vehicle 10 in wireless communication with roadside unit 14. The roadside unit 14 is in communication with a traffic controller 16. The traffic controller 16 may receive traffic data from a plurality of such roadside units. The traffic controller is able to determine optimum travel speeds at various points along the highway. The optimal travel speeds can then be communicated to the vehicle 10 by transmission from the roadside unit 14 (or other roadside unit) to the vehicle unit 12. As the vehicle moves along the highway, suggested speeds may be transmitted to the vehicle unit using other roadside units, and the vehicle may receive an updated suggested speed from later encountered roadside units.

Figure 1B:
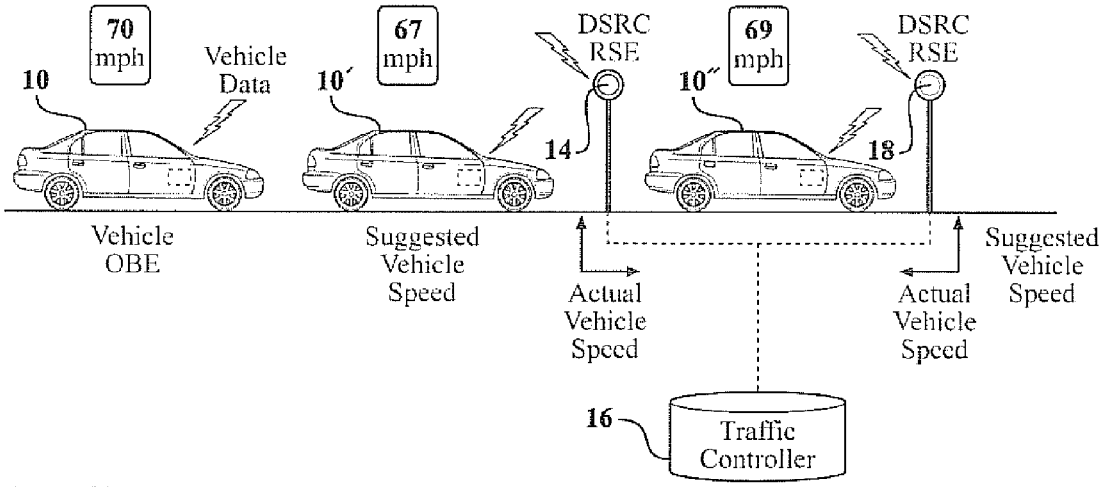

FIG. 1B shows a vehicle moving along the highway, the vehicle being shown at positions 10, 10', and 10" corresponding to movement along the highway. Roadside units 14 and 18 are in communication with the traffic controller 16. The traffic controller receives traveling speed data from vehicles, received by wireless transmission from the vehicle unit to the roadside unit. As the vehicle moves along the highway, it may lose contact with one roadside unit and later or simultaneously become within range of a second roadside unit.

The vehicle unit may include vehicle OBE (onboard electronics), and may include a two-way wireless communications device connected to the vehicle electronics systems. The roadside unit, including a wireless communication device, may be denoted RSE (roadside electronics). The traffic controller is in communication with the roadside unit by wireless, wired, optical fiber, or other communications link.

As the vehicle travels along a highway, a determination is made of an average speed over a predetermined time period. The predetermined time period may be, for example, less than minutes, such as a time period in the range of 5 seconds—2 minutes, such as 1 minute. The predetermined time may alternatively correspond to the time taken to travel a certain distance, such as the distance between two roadside units.

When the vehicle unit is within communication range of a roadside unit, the vehicle unit transmits data to the roadside unit using wireless communication. For example, 5.9 gigahertz DSRC (dedicated short range communications) may be used for a system of this type. The roadside unit collects data from a plurality of vehicles, and transfers the data to a traffic controller where data from various vehicles (and optionally, roadside sensors or other sources) is aggregated to produce an average vehicle traveling speed (traffic speed) for the highway or portions thereof. The average vehicle traveling speed may be determined as a function of position and time on the highway.

Figure 1C:
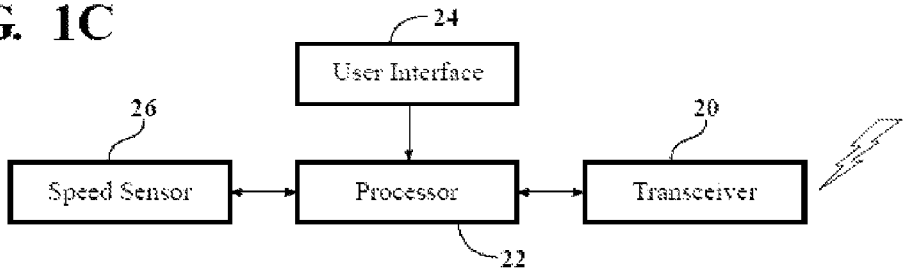

FIG. 1C shows a simplified schematic of vehicle electronics in the form of a vehicle unit 12 including a transceiver 20, an electronic circuit (in this example a processing circuit 22), and user interface 24. The vehicle unit receives a speed sensor signal from the speed sensor 26. The electronic circuit determines a vehicle speed from the speed signal, for example as an average speed over a predetermined time. The transceiver is operable to transmit the vehicle speed to a roadside unit, when the roadside unit is within range, and is further operable to receive a suggested speed from the same or different roadside unit. The user interface may comprise any mechanism used to convey the suggested speed to the driver.

During operation, the traffic controller compares the present traffic speed (for example, the average speed of some or all of the vehicles on the highway) with the posted speed limit. When the difference is not significant, for example when traffic is moving at 1 mph below the posted speed limit, no action may be needed. Also, if the traffic speed is greater than the posted speed limit, no action may be taken. However, when the present vehicle speed is significantly less than the posted speed limit, the traffic controller can determine that it is better to increase the traveling speed. If the vehicle speed is significantly different from the average vehicle speed (traffic speed), the suggested speed may be equal or approximately equal to the traffic speed. A significant speed difference may be, for example, a difference of 3 mph or greater, such as 5 mph or greater. The suggested speed may be rounded, for example to the nearest whole mph, or other increment.

Figure 2A:
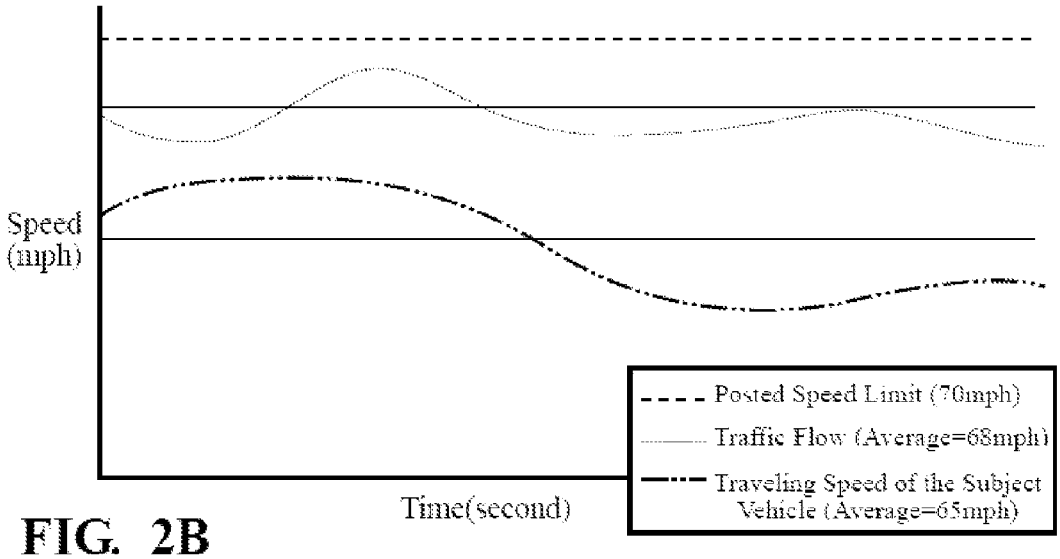
FIGS. 2A and 2B illustrate comparisons of vehicle speed, traffic speed, and posted speed limits.

FIG. 2A shows vehicle speed data that may be collected by an example traffic controller. The figure illustrates the vehicle speed (of the subject vehicle), traffic speed, and posted speed limit. In this example, traffic speed is an average speed of vehicles within a portion of the highway.

In FIG. 2A, the vehicle speed is below the posted speed limit and also below that of the traffic flow. The traffic controller and vehicle unit indicate a suggested speed which is faster than the present vehicle speed to the driver. If the driver speeds up so that the vehicle speed matches the suggested speed, the subject vehicle then drives along with the traffic flow on the highway.

Data such as that shown in FIG. 2A may be obtained from individual lanes of the highway. In that case, the traffic speed is an average for vehicles within a certain lane within a portion of the highway.

Figure 2B:
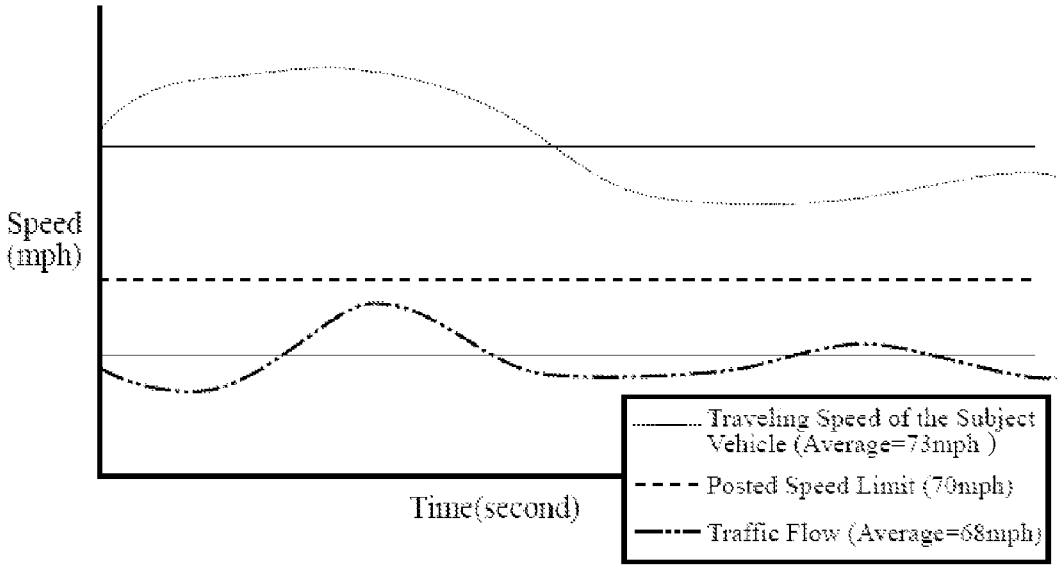

FIG. 2B shows a case where the vehicle speed is higher than both the posted speed limit and that of the traffic flow. In this case the suggested speed is lower than the existing traveling speed of the subject vehicle. This suggestion allows a subject vehicle to drive along with the traffic flow on the highway. Again, data such as shown in FIG. 2B may be collected for an individual lane of the highway.

Figure 3A:
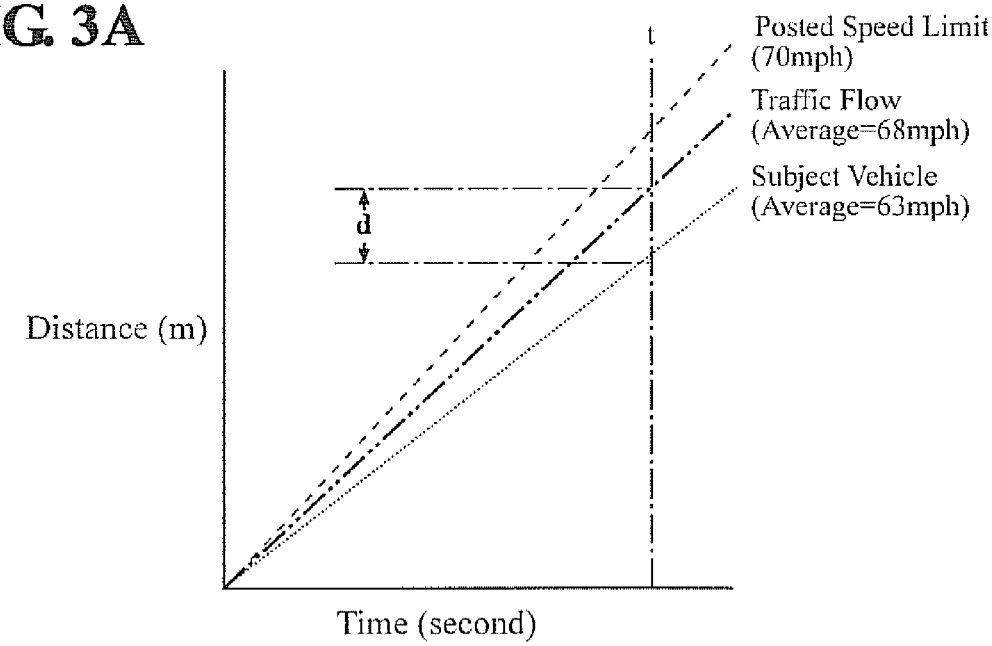
FIGS. 3A and 3B illustrate similar comparisons to FIGS. 2A and 2B, using a distance versus time presentation.

FIG. 3A shows vehicle travel characteristics within the time-space domain. If a vehicle travels at a constant speed, it gains a certain distance proportional to the time period. In this case, the difference between the vehicle speed and traffic speed gives a separation distance d after a time shown as a vertical line (t). By providing a suggested vehicle speed that is similar to the average traffic speed, the separation d can be reduced.

If a new suggested speed is indicated to the driver at a certain time, and the driver then changes to that speed, the distance between the traffic flow and subject vehicle can be reduced. This is shown in FIG. 3B.

Figure 3B:
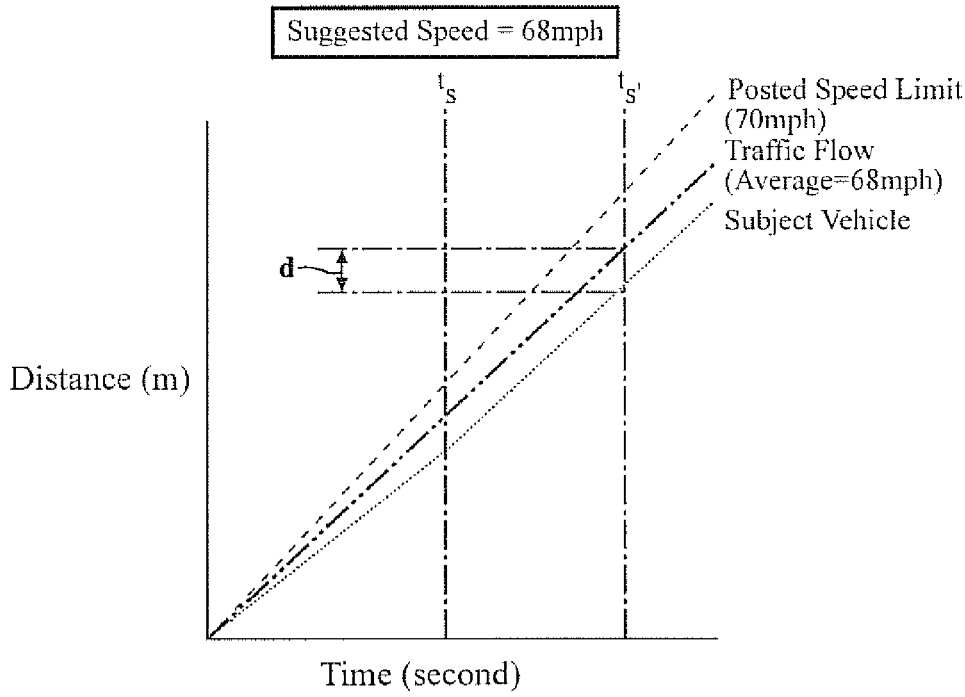

FIG. 3B shows the distance between a subject vehicle and traffic flow positions as d, and this is reduced from that shown in FIG. 3A due to the modification of the vehicle speed. The traffic flow may be represented by a point moving at the average speed of the vehicles within the highway portion, and this point matches the vehicle position at the start of the comparison. In this example, the vehicle speed changes at time $t_s$ to a suggested speed, and after that time the value of d is constant as a function of time. This shows that the vehicle speed matches the traffic speed when the driver modifies the vehicle speed to equal the suggested speed.

Existence of traffic congestion can be detected by observing vehicle travel data from other vehicles on the highway. If the traffic controller identifies the existence of such traffic congestion, it can determine an optimal speed for the vehicle to avoid the congestion. This optimal speed is conveyed to the driver as a suggested speed.

FIG. 4 illustrates congestion avoidance using a suggested speed. In FIG. 4, the solid line represents traffic speed as a function of distance. Within a shallow gradient region (designated 40), traffic flow speed is reduced, indicating traffic congestion on a later highway portion. If the subject vehicle proceeds using its original speed (shown as a dashed line) towards this portion, the vehicle encounters the traffic congestion by a later time $t_{s''}$. However, by reducing the vehicle speed to the suggested speed at time $t_s$, the subject vehicle avoids the traffic congestion (as shown by reduced gradient dotted line 42 corresponding to a reduced speed). In this example, a suggested speed is indicated to the driver that is lower than both the present vehicle speed and surrounding traffic speed. By immediately adjusting the vehicle speed to the suggested speed, the subject vehicle avoids the traffic jam.

FIG. 5 shows a method according to an example of the present invention. Box 100 corresponds to determining the vehicle speed. This may be an average speed over a predetermined time. Box 102 corresponds to transmitting speed data to the traffic controller, via a roadside unit. Box 104 corresponds to the traffic controller analyzing speed data from a plurality of vehicles. Box 106 corresponds to determining a suggested speed. For example, the suggested speed may be equal to, or otherwise a function of, an average speed for vehicles within a portion of the highway. The portion may be the portion the vehicle is presently traveling through, or a portion towards which the vehicle is heading. Box 108 corresponds to transmitting the suggested speed to the vehicle, for example through the same or a different roadside unit. Box 110 corresponds to conveying the suggested speed to the driver, for example through audible and/or visual mechanisms.

In some examples, an individual vehicle can be targeted with a suggested speed that matches that of the surrounding traffic. For example if a vehicle is traveling at 60 mph along a 70 mph speed limit highway, while other vehicles are moving at 68 mph, the traffic controller can identify the slow vehicle using the vehicle-to-infrastructure communication and transmit a suggested speed to the vehicle. In this example, the suggested speed may be 68 (the traffic speed), or similar speed.

Examples of the present invention also allow improved traffic management at highway merges and intersections. For example, the traffic controller may identify regions of slow traffic at intersections or merges from local roads. In these cases, traffic approaching the intersection or merge may have a suggested speed that is reduced, relative to the posted speed limit, allowing the vehicles to avoid rapid deceleration or in some cases to avoid congestion altogether.

Hence, as a result of vehicle-to-infrastructure communication on present and optimized traveling speeds, the traffic controller can manage the traffic speed more effectively so as to prevent or mitigate traffic congestion and improve highway throughput. The vehicle operators receive benefits of relatively freely flowing traffic.

Hence, an example apparatus includes a vehicle unit that transmits vehicle speed to a roadside unit, receives the suggested speed from the roadside unit, and conveys the suggested speed to the driver.

The speed sensor may be the vehicle speedometer or associated component. However, a direct vehicle speed sensor need not be used. The vehicle speed sensor may include global positioning system (GPS) electronics associated with the vehicle, or the source of another signal that is a representative of the vehicle speed, such as rpm and gear used.

In some examples, vehicle speed need not be determined from vehicle communication. For example, roadside sensors, traffic cameras, radar, and the like can be used to determine vehicle speeds on a highway. In such examples, the vehicle unit may be used to receive the suggested speed and convey the suggested speed to the driver.

A vehicle unit is associated with a subject vehicle, and may include a transceiver, speed analysis circuit, a user interface, and any other electronic circuit necessary to provide the desired functionality. In operation, the vehicle unit receives a speed signal, for example at intervals from vehicle electronics such as an engine control unit or any other appropriate source of speed or speed-correlated signal. The vehicle unit may include an interface circuit operable to communicate with one or more vehicle electronic systems. The speed signal may be provided by a speed sensor, GPS, or other navigation system associated with the vehicle.

The vehicle unit may include an electronic circuit, such as a processor-based circuit, operable to compute vehicle speed data for transmission to the roadside unit. The transmitted vehicle speed data may be a rolling average of vehicle speed, for example an average over the previous 60 seconds or other time interval.

The vehicle unit is operable to receive a suggested speed from a roadside unit. The suggested speed may be received from the same roadside unit that received the vehicle speed, or may be received from a different roadside unit.

A user interface is used to convey the suggested speed to the driver. The user interface may include one or more of the following: an audible signal transducer (which may include a speaker and an audible signal generator such as a tone source or voice synthesizer), a visual transducer (such as a lamp, numeric display, or other display), haptic transducer, and the like.

For example, the suggested speed may be displayed using one or more of the following: a numeric display, a lamp proximate the speedometer (for example using lamps in an arcuate form around the periphery or inner portion of an analog-style speedometer), any modified speedometer, a tone to indicate whether the driver should speed up or slow down, other indicator light(s), synthesized speech to give instructions to the driver, or any other appropriate method.

The suggested speed may be conveyed to the driver in absolute and/or relative forms. For example, if the suggested speed is 65 mph, a display or modified speedometer may indicate 65 mph in any appropriate manner. However, the driver may prefer to receive relative data, for example as an indication to speed up or slow down, depending on the relative magnitudes of the suggested speed and present vehicle speed. For example, a lamp may indicate red or green (or other color combination), depending on whether the suggested speed is faster or slower than the present vehicle speed. A tone signal (e.g. of variable pitch), voice synthesis, or other method may also be used to convey such information.

In an example approach to conveying the suggested speed, the vehicle unit compares the suggested speed with the present vehicle speed and conveys the comparison to the driver using the user interface.

In an example of an improved adaptive cruise control, the suggested speed is received from the traffic controller and conveyed to the adaptive cruise control, which is in electronic communication with the vehicle unit. The suggested speed may override the driver's preferred speed as the target traveling speed for the vehicle. For example, the vehicle may be slowed ahead of congestion so as to avoid the congestion and the need for sudden deceleration later. This approach allows improved operation of the adaptive cruise control, and may be used to avoid the need for driver inputs by avoiding challenging congested conditions ahead.

A vehicle unit may have additional functionality, such as alerting the driver to approaching emergency vehicles, traffic intersections, stalled vehicles, adverse weather, and the like. The vehicle unit may have a housing supported by the vehicle. However, the term "vehicle unit" should not be read as limited to a single component. A vehicle unit may be provided by a combination of functionalities, for example a vehicle computer or GPS determining an average speed, a transceiver provided as part of an enhanced radio, and a user interface provided by a modified speedometer and/or radio. A vehicle unit may be fully or partially integrated with existing vehicular electronic systems, such as an entertainment device, navigation system, GPS, vehicle control electronics, and the like.

An example roadside unit receives vehicle speed from the vehicle unit and transmits speed data to the traffic controller. The roadside unit also receives the suggested speed from the traffic controller and conveys it to the vehicle.

A roadside unit may include a transceiver operable to communicate with suitably equipped vehicles, and a communications link to the traffic controller. A roadside unit may include an electronic circuit, transceiver, power supply (or source thereof); other associated components, and may be supported in a housing having an antenna.

Roadside units may be provided at intervals along a highway. The term "roadside" is not intended to be limiting to a unit located in the highway shoulder. A roadside unit may be supported at the side of the road such as a shoulder, for example mounted on a post, but may also be supported over the roadway on a gantry, within a median, or located under the roadway or otherwise proximate the highway. The roadside unit may be partially or fully integrated with devices having additional functionality, such as a warning sign, speed limit sign, traffic control signal, and the like. A roadside unit may include a GPS or other location-determination system, otherwise programmed with a location, or otherwise identifiable with a location by the traffic controller.

A roadside unit may provide other functionality, such as ambient condition sensors (such as temperature, precipitation, and light sensors, and the like), and may be in communication with other networks, such as the Internet or other network (such as a highway infrastructure network). The roadside unit may communicate with various sensors as desired, such as a video camera, temperature sensor, and the like. A roadside unit may also provide vehicle tracking functionality, for example for a business wishing to monitor the progress of a vehicle. The roadside unit may include an electronic circuit, for example a processor-based circuit, which may provide local data analysis. For example, a roadside unit may compute traffic speed and density from video or other traffic sensor data. Different elements of the roadside unit may be at different locations, for example the antenna may be raised above the roadway level, and other electronic components located nearer ground level.

The traffic controller receives vehicle speed data for a plurality of vehicles from one or more roadside units. The traffic controller determines a suggested speed for vehicle travel on the highway and transmits the suggested speed(s) to the roadside units. The suggested speeds may vary as a function of position along the highway according to local traffic conditions, so that each roadside unit may transmit a local suggested speed for that highway portion.

The traffic controller includes communications devices to communicate with the roadside units. These may be wireless transceivers, or wired communication can be used. The traffic controller receives speed data from a plurality of vehicles on a highway, or a portion thereof.

The traffic controller may include a computation circuit, such as a processor-based circuit, and may include a database and other memory components. The suggested speed may be computed by an algorithm executed by a processor within an electronic circuit within the traffic controller. The suggested speed may be a function of an average speed of vehicles on a highway or portion thereof.

For example, the traffic controller may determine a traffic speed for the present highway portion (the highway portion that the subject vehicle is presently traveling on). In some examples, the suggested speed may be computed as the average (mean or median) traffic speed for vehicles on the present highway portion, and the average may include the speed of the subject vehicle.

In other examples, the suggested speed may be computed so as to assist the subject vehicle avoid congestion on a highway portion ahead of the subject vehicle (a highway portion towards which the vehicle is traveling). The suggested speed is lower than the traffic speed on the present highway portion, and calculated so that the subject vehicle arrives at the presently congested portion after the congestion has dispersed or moved ahead. The suggested speed may be calculated so that the subject vehicle does not catch up with a wave of congestion propagating along the highway.

The traffic controller may use previously collected data, which may be stored in a database accessible with the traffic controller. An adaptive learning approach can be used to improve suggested speeds, for example by monitoring the vehicle to determine if the suggested speed was actually the optimum speed to reduce congestion, and making appropriate corrections to future suggested speeds.

The suggested speed may be determined using present traffic speed, present traffic density, future calculated traffic speed and density, vehicle type, and ambient conditions. For example, night-time or adverse weather conditions may lead to a reduced suggested speed for a given traffic density. The acceleration and braking (deceleration) characteristics of the vehicle may be used to determine the suggested speed. For example, the suggested speed for a truck may be lowered further in advance of congestion, compared with an automobile.

In an example of system operation, the traffic speed in a highway portion ahead of the subject vehicle is substantially lower than the present subject vehicle speed. The traffic density ahead of the subject vehicle may be close to or exceeding a threshold density at which stop-go traffic may be expected. Hence, if the subject vehicle catches up with traffic ahead, then traffic densities may exceed the threshold for stop-go traffic. In such an example, the suggested speed can be determined as lower than the present vehicle speed, reducing the probability of excessive traffic density ahead on the road.

Hence, in examples of the present invention, the traffic controller can be programmed to smooth out traffic density, as well as determine suggested speeds that optimize traffic flow. A traffic controller may be operable to provide suggested vehicle speeds that avoid excessive traffic density or decelerations of a vehicle on the highway.

For example, in the case where vehicles ahead of the subject vehicle are decelerating sharply, the suggested speed may be reduced from both the posted speed limit and present traffic speed. By slowing the subject vehicle before it reaches the region of sharply decelerating traffic, the driving experience is made smoother and less aggravating for the driver. Examples of the present invention include conveying suggested speeds to the driver that appreciably reduce or substantially eliminate deceleration of the subject vehicle. Vehicle gas mileage can be increased by reducing decelerations of the subject vehicle, saving the driver money.

Traffic smoothing can be optimized using suggested speeds for optimal traffic flow. In such examples unexpected acceleration and deceleration of vehicles on the highway can be reduced.

Examples of the present invention can work with other systems, such as variable speed limit systems. A variable speed limit (VSL) may be taken into account when determining the suggested speed. Some aspects of the present invention can be implemented by a VSL system, for example the suggested speed may be given to all vehicles using a VSL display. However, the use of a vehicle unit is advantageous over conventional VSL systems, for example as there is no need for VSL hardware used to display speeds.

Examples of the present invention can also work with intelligent speed adaptation systems (ISA). The suggested speed may take into account the time of day, location, vehicle type, and driver type. For example, the suggested speed may be lower for an inexperienced driver. Conventional ISA systems do not suggest an optimal vehicle speed within an existing speed limit. However, examples of the present invention include approaches that may provide all advantages of ISA, along with an optimized suggested speed for enhanced highway throughput.

Hence, examples of the present invention allow a vehicle speed to be accurately matched to the surrounding traffic speed, allowing optimal throughput of vehicles on a highway. In some examples, a region of slower traffic flow ahead of the vehicle can be used to determine a reduced suggested speed, allowing such congestion to be reduced, eliminated, or avoided by the driver of the subject vehicle.

The invention is not restricted to the illustrative examples described above. Examples described are not intended to limit the scope of the invention. Changes therein, other combinations of elements, and other uses will occur to those skilled in the art. The scope of the invention is defined by the scope of the claims.

Having described my invention, I claim:

1. An apparatus for assisting traffic control, the apparatus comprising:

a vehicle unit, the vehicle unit including a transceiver, and being configured to be supported by a vehicle;

a roadside unit, located proximate a highway portion, the roadside unit being in communication with the vehicle unit when the vehicle unit is located on the highway portion; and a traffic controller, in communication with the roadside unit, the traffic controller receiving vehicle speed data from the roadside unit, and operable to determining a suggested speed for the vehicle, the suggested speed being transmitted from the roadside unit to the vehicle unit, the vehicle unit being operable to convey the suggested speed to the driver;

wherein the suggested speed being greater than, less than, or equal to the vehicle speed, the suggested speed being calculated so as to allow the vehicle to avoid encountering traffic congestion on the portion of highway ahead of the vehicle; and wherein the suggested speed is determined by a comparison of at least two of: a vehicle speed of the vehicle, vehicle speed of one or more traffic vehicles, and a posted speed limit.

2. The apparatus of claim 1, the suggested speed being an average speed of vehicles on the highway portion.

3. The apparatus of claim 2, the suggested speed being an average speed of vehicles on a traffic lane of the highway portion, the vehicle being located in the traffic lane.

4. The apparatus of claim 1, the apparatus including a plurality of roadside units, the traffic controller receiving vehicle speed data from each roadside unit.

5. The apparatus of claim 4, the suggested speed being less than the vehicle speed, the suggested speed being calculated so as to allow the vehicle to avoid encountering traffic congestion on the portion of highway ahead of the vehicle.

6. The apparatus of claim 4, the suggested speed being determined using an average speed of vehicles located on the highway ahead of the highway portion.

7. The apparatus of claim 1, the transceiver being a DSRC (dedicated short range communications) transceiver.

8. The apparatus of claim 1, the suggested speed being conveyed to the driver using a visual signal.

9. The apparatus of claim 1, the suggested speed being conveyed to the driver using a audible signal.

10. A method of improving traffic flow on a highway, the traffic flow including a vehicle having a driver, the method comprising:

determining the vehicle speed;

transmitting the vehicle speed to a traffic controller, using a roadside unit in communication with a vehicle unit associated with the vehicle;

determining an average speed for a plurality of vehicles within a portion of the highway;

determining a suggested speed for the vehicle, the suggested speed being a function of the average speed;

transmitting the suggested speed to the vehicle; and conveying the suggested speed to the driver, so as to assist the driver achieve a vehicle speed that improves traffic flow; and wherein the suggested speed being greater than, less than, or equal to the vehicle speed, the suggested speed being calculated so as to allow the vehicle to avoid encountering traffic congestion on the portion of highway ahead of the vehicle; and wherein the suggested speed is determined by a comparison of at least two of: a vehicle speed of the vehicle, vehicle speed of one or more traffic vehicles, and a posted speed limit.

11. The method of claim 10, further including:

transmitting the vehicle speed from the vehicle to the roadside unit using a DSRC (dedicated short range communications) wireless communication link, and receiving the suggested speed from the roadside unit using the DSRC wireless communication link.

12. The method of claim 10, the portion of the highway including the vehicle, the suggested speed being equal to the average speed of the plurality of vehicles within the portion of the highway.

13. The method of claim 10, the portion of the highway being a highway portion ahead of the vehicle.

14. The method of claim 13, the suggested speed being a function of the average speed for the plurality of vehicles, and the distance between the vehicle and the highway portion ahead of the vehicle.

15. The method of claim 10, the vehicle being located within a traffic lane, the plurality of vehicles being located within the traffic lane.

16. An apparatus for improving traffic flow on a highway, the apparatus being associated with a road vehicle having a driver, the apparatus comprising:

an electronic circuit, operable to receive a speed signal from vehicle electronics and determine a vehicle speed;

a transceiver, operable to transmit the vehicle speed to a traffic controller through a roadside unit proximate the highway portion when the vehicle is located on the highway portion, the transceiver being further operable to receive a suggested speed from the traffic controller, the suggested speed being greater than, less than, or equal to the vehicle speed, the suggested speed being calculated so as to allow the vehicle to avoid encountering traffic congestion on the portion of highway ahead of the vehicle; and wherein the suggested speed is determined by a comparison of at least two of: a vehicle speed of the vehicle, vehicle speed of one or more traffic vehicles, and a posted speed limit; and a user interface, operable to convey the suggested speed to the driver.

17. The apparatus of claim 16, the transceiver being a DSRC transceiver.

18. The apparatus of claim 16, the user interface including a visual display.

19. The apparatus of claim 16, the user interface providing an audible signal correlated with the suggested speed.

* * * * *